US008362703B2

(12) United States Patent
Kumar et al.

(10) Patent No.: US 8,362,703 B2
(45) Date of Patent: Jan. 29, 2013

(54) LIGHT-EMITTING DEVICES

(75) Inventors: Rashmi Kumar, Billerica, MA (US); Robert F. Karlicek, Jr., Chelmsford, MA (US); Paul Panaccione, Newburyport, MA (US)

(73) Assignee: Luminus Devices, Inc., Billerica, MA (US)

( * ) Notice: Subject to any disclaimer, the term of this patent is extended or adjusted under 35 U.S.C. 154(b) by 909 days.

(21) Appl. No.: 12/341,918

(22) Filed: Dec. 22, 2008

(65) Prior Publication Data

US 2009/0284161 A1 Nov. 19, 2009

Related U.S. Application Data

(60) Provisional application No. 61/015,344, filed on Dec. 20, 2007.

(51) Int. Cl.
*H05B 37/02* (2006.01)

(52) U.S. Cl. ..... 315/209 R; 315/291; 362/800; 257/79

(58) Field of Classification Search ..... 315/209 R, 315/225, 291, 307; 362/249.01–249.13, 362/800; 257/79, 97–99, E25.019, E25.02, 257/E25.028, E33.053
See application file for complete search history.

(56) References Cited

U.S. PATENT DOCUMENTS

| | | | | |
|---|---|---|---|---|
| 4,259,680 | A | 3/1981 | Lepselter et al. | |
| 4,719,405 | A | 1/1988 | Boucher | |
| 4,777,516 | A | 10/1988 | Deschler et al. | |
| 5,414,616 | A | 5/1995 | Hatozaki | |
| 5,814,841 | A | 9/1998 | Kusuda et al. | |
| 5,866,925 | A | 2/1999 | Zolper et al. | |
| 6,005,649 | A | 12/1999 | Krusius et al. | |
| 6,441,404 | B1 * | 8/2002 | Yamamoto | 257/99 |
| 6,501,167 | B2 | 12/2002 | Hanamura | |
| 6,587,490 | B2 | 7/2003 | Crawford | |
| 6,593,597 | B2 | 7/2003 | Sheu | |
| 6,636,252 | B2 * | 10/2003 | Hiraoka | 347/238 |
| 6,696,704 | B1 * | 2/2004 | Maeda et al. | 257/98 |
| 6,697,402 | B2 * | 2/2004 | Crawford | 372/38.03 |
| 6,831,302 | B2 | 12/2004 | Erchak et al. | |
| 6,924,744 | B2 | 8/2005 | Bohlander et al. | |
| 6,933,707 | B2 | 8/2005 | Allen | |
| 7,038,253 | B2 | 5/2006 | Yoshida et al. | |
| 7,075,252 | B1 | 7/2006 | Blackwood | |
| 7,170,100 | B2 | 1/2007 | Erchak et al. | |
| 7,817,009 | B2 * | 10/2010 | Wang et al. | 338/25 |
| 8,110,835 | B2 | 2/2012 | Kumar et al. | |
| 2003/0013241 | A1 | 1/2003 | Rockwell et al. | |
| 2003/0117348 | A1 | 6/2003 | Knapp et al. | |
| 2004/0188696 | A1 | 9/2004 | Hsing Chen et al. | |
| 2005/0185428 | A1 | 8/2005 | Crawford et al. | |
| 2006/0060878 | A1 | 3/2006 | Kim et al. | |
| 2006/0092639 | A1 | 5/2006 | Livesay et al. | |
| 2007/0069663 | A1 | 3/2007 | Burdalski et al. | |
| 2007/0246736 | A1 | 10/2007 | Senda et al. | |
| 2008/0290819 | A1 | 11/2008 | Hoepfner et al. | |

OTHER PUBLICATIONS

Dodabalapur, A., et al., "Organic smart pixels," *Applied Physics Letters*, vol. 73, No. 2, pp. 142-144, Jul. 13, 1998.
"Building a TinyFlashLED," *Atmel Applications Journal*, Issue 5, Summer 2005, pp. 41-43.

* cited by examiner

*Primary Examiner* — Jimmy Vu
(74) *Attorney, Agent, or Firm* — Wolf, Greenfield & Sacks, P.C.

(57) ABSTRACT

Light-emitting devices, and related assemblies, systems and methods are described. Specifically, at least some of the embodiments relate to light-emitting devices including proximate switching element(s). The switching element(s) control the current, or power, supplied to the light-emitting devices.

14 Claims, 10 Drawing Sheets

LIGHT-EMITTING DEVICES

RELATED APPLICATIONS

This application claims priority to U.S. Provisional Patent Application Ser. No. 61/015,344, filed Dec. 20, 2007, which is incorporated herein by reference.

FIELD OF THE INVENTION

The present embodiments are drawn generally towards light-emitting devices, and related assemblies, systems and methods. Specifically, at least some of the embodiments relate to light-emitting devices (e.g., light-emitting diodes) including proximate switching element(s).

BACKGROUND

A light-emitting diode (LED) can provide light in a more efficient manner than an incandescent light source and/or a fluorescent light source. The relatively high power efficiency associated with LEDs has created an interest in using LEDs to displace conventional light sources in a variety of lighting applications. For example, in some instances LEDs are being used as traffic lights and to illuminate cell phone keypads and displays.

Typically, an LED is formed of multiple layers, with at least some of the layers being formed of different materials. In general, the materials and thicknesses selected for the layers influence the wavelength(s) of light emitted by the LED. In addition, the chemical composition of the layers can be selected to promote isolation of injected electrical charge carriers into regions (commonly including quantum wells) for relatively efficient conversion to light. Generally, the layers on one side of the junction where a quantum well is grown are doped with donor atoms that result in high electron concentration (such layers are commonly referred to as n-type layers), and the layers on the opposite side are doped with acceptor atoms that result in a relatively high hole concentration (such layers are commonly referred to as p-type layers).

LEDs also generally include contact structures (also referred to as electrical contact structures or electrodes), which are conductive features of the device that may be electrically connected to an electrical power source or converter (also referred to as a driver). The power source can provide electrical current to the device via the contact structures, e.g., the contact structures can deliver current along the lengths of structures to the surface of the device within which light may be generated. For example, an LED can have electrical power transmitted via an electrical connection wire that transmits electrical power from the power source. This is typically accomplished with little thought to the specifics of the connection wire.

SUMMARY

Light-emitting devices, as well as related assemblies, systems, and methods are described.

In one aspect, an assembly comprises a light-emitting diode, a power source; and a switch arranged between the light-emitting diode and the power source. The switch is configured to provide current to the light-emitting diode from the power source when in a first state and to not provide current from the power source to the light-emitting diode when in a second state. A distance between the light-emitting diode and the switch is less than 5 cm.

In one aspect, an assembly comprises at least one light-emitting diode, and a flexible cable having a first and second ends, wherein the first end of the flexible cable is electrically connected to the light-emitting diode, and wherein the flexible cable is configured to transmit electrical power to the light-emitting diode, and wherein the flexible cable comprises a first electrically conductive layer, a second electrically conductive layer disposed over the first electrically conductive layer, wherein the first and second electrically conductive layers substantially overlay each other and have substantially the same area, and an electrically insulating layer disposed between the first and second electrically conductive layers.

In one aspect, a method of providing power to at least one light-emitting diode comprises transmitting electrical power to at least one light-emitting diode through at least one flexible cable, wherein the flexible cable comprises a first electrically conductive layer, a second electrically conductive layer disposed over the first electrically conductive layer, wherein the first and second electrically conductive layers substantially overlay each other and have substantially the same area, and an electrically insulating layer disposed between the first and second electrically conductive layers.

In one aspect, a flexible cable comprises a first electrically conductive layer, a second electrically conductive layer disposed over the first electrically conductive layer, wherein the first and second electrically conductive layers substantially overlay each other and have substantially the same area, and an electrically insulating layer disposed between the first and second electrically conductive layers.

Other aspects, embodiments and features of the invention will become apparent from the following detailed description of the invention when considered in conjunction with the accompanying figures. The accompanying figures are schematic and are not intended to be drawn to scale. In the figures, each identical or substantially similar component that is illustrated in various figures is represented by a single numeral or notation.

For purposes of clarity, not every component is labeled in every figure. Nor is every component of each embodiment of the invention shown where illustration is not necessary to allow those of ordinary skill in the art to understand the invention. All patent applications and patents incorporated herein by reference are incorporated by reference in their entirety. In case of conflict, the present specification, including definitions, will control.

DETAILED DESCRIPTION

Light-emitting devices, and related assemblies, systems and methods are described. Specifically, at least some of the embodiments relate to light-emitting devices including proximate switching element(s) which control the current (or power) supplied to the light-emitting devices. The light output of an LED can be varied based on the electrical current (or power) provided to the LED. A regulated current may be provided to facilitate the control of the light output of the LED, and power converter (also referred to as a driver circuit herein) may be used to provide current to the LED. The driver circuit may include a current source, which may in turn comprise a current regulator that can output a desired current. The driver circuit may include one or more switches that can be switched so as to turn on and off the LED light emission by controlling the current supplied to the LED. The switches may include transistors, such as field-effect transistors or bipolar transistors. As described further below, in some embodiments, a switch may be located proximate to the LED. The inventors have appreciated that locating the switch proximate to the LED may limit switching delays when the current is varied, such as when the current is pulsed, which can otherwise be problematic, for example, during fast switching of LEDs including very high driving currents. The switch(es), for example, may be on a connection cable, on the LED module (e.g., on the package), on the power converter module, and/or on a separate module (e.g., switching module or board) positioned close to the LED, amongst other possibilities.

By situating a switching element in close proximity (e.g., less than about 5 cm apart, less than about 1 cm apart, less about 5 mm apart, less than about 1 mm apart, less than about 0.5 mm apart) to the LED, fast switching of the LED may be achieved, amongst other advantages. The operation of the integrated switching element (e.g., placing the switching element in a closed or open state) may be used set the current provided to the LED. In some embodiments, the switching element is electrically connected in parallel with an LED and can serve as a current shunt to divert current away from the LED when the current switching element is closed (e.g., acting as a short circuit).

The distances noted above between the switching element and the LED are measured as the length of the electrical connection between the contact on the switching element (that is connected to the LED) and the corresponding contact on the LED (that is connected to the switching element). The contact on the LED may be, for example, a cathode bond pad.

Figure 1A:
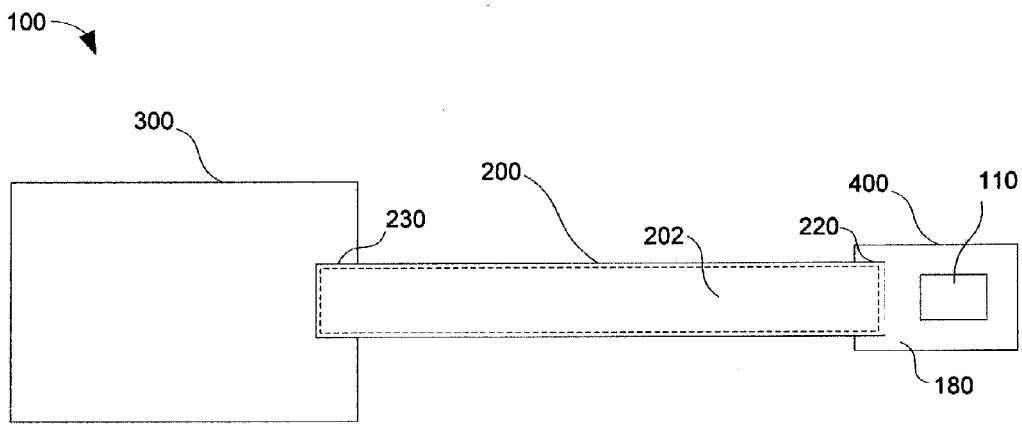
FIG. 1A is a top view of an assembly comprising an LED module and a flexible cable, in accordance with one embodiment.
Figure 1B:
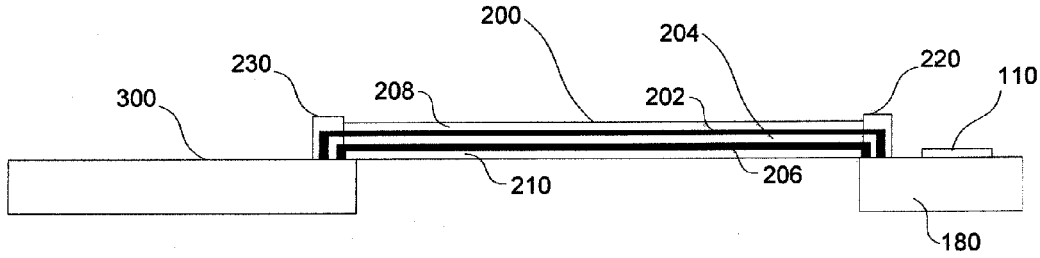
FIG. 1B is a side cross-section view of the assembly of FIG. 1A, in accordance with one embodiment.
Figure 1C:
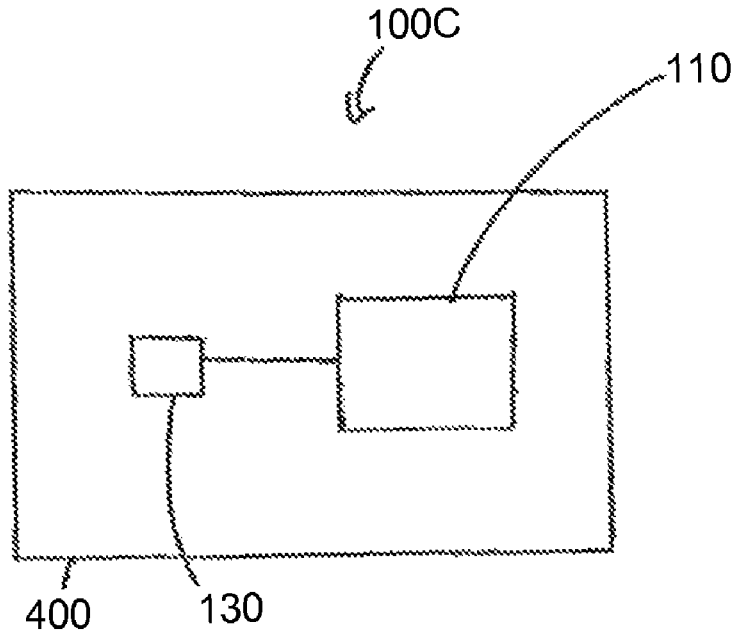
FIG. 1C is a top view of an assembly including an LED module in accordance with one embodiment.
Figure 1D:
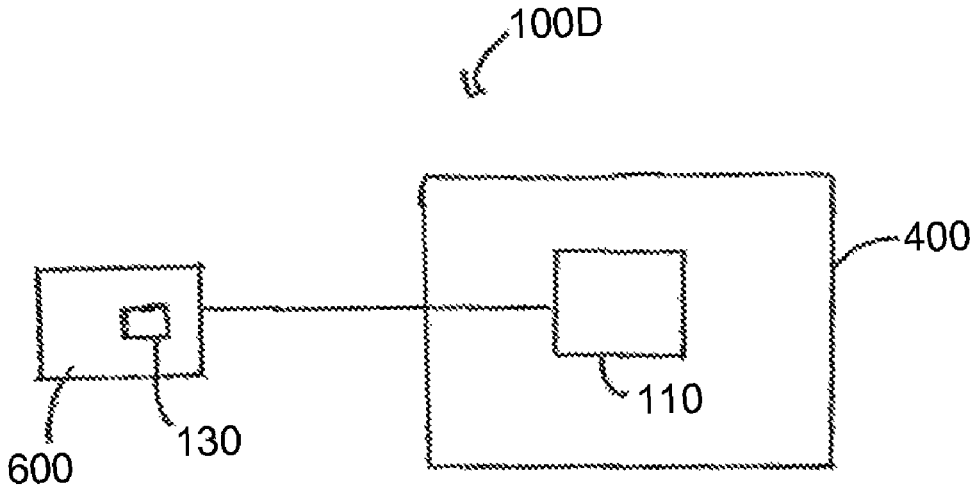
FIG. 1D is a top view of an assembly including an LED module in accordance with one embodiment.

FIGS. 1A and 1B illustrate a top view and a side cross-section view, respectively, of an assembly 100 comprising an LED module 400, a power converter module 300, and a cable 200. LED module 400 can include an LED 110 comprising a light-generating layer (e.g., an active region of a semiconductor LED) and a package substrate 180 (e.g., a metal core-board). In this embodiment, a switching element 130 is on the cable as described further below. FIG. 1C shows another embodiment in which assembly 100*c* includes switching element 130 on the LED module. FIG. 1D shows another embodiment in which the assembly 100*d* includes switching element 130 on another module 600 (e.g., switching module) separate from the LED module and the power converter module (not shown).

The inventors have appreciated that the designs described herein can facilitate the high current (e.g., greater than about 1 A, greater than about 5 A, greater than about 10 A, greater than about 20 A) and/or short rise/fall time (e.g., less than about 1 μs, less than about 500 ns, less than about 300 ns, less than about 200 ns, less than about 100 ns, less than about 50 ns) operation of the LED.

One potential difficulty associated with certain conventional designs realized by the inventors is that the electrical wire connection carrying a high current pulsed signal with short rise/fall times may operate as an antenna and may broadcast RF signals. The designs (including the cable designs) described herein can reduce or eliminate these difficulties.

Another potential difficulty associated with certain conventional designs is that the electrical connection carrying a high current pulsed signal may possess a large inductance that may result in large rise/fall times for current carried by the electrical connection, thereby inhibiting the fast switching of the LED. Short rise/fall times of current in LEDs may be desirable to improve performance of a system incorporating the LEDs. For example, short rise/fall times can facilitate the reduction of output wavelength shift due to varying current density and/or enable very low duty cycles for pulsed switching of LEDs (e.g., to improve a dimming scale of the LED). Wavelength shifts effects (e.g., light output peak wavelength shifts of greater than about 5 nm, greater than about 10 nm) may be significant for large current densities (e.g., greater than about 0.5 A/mm$^2$, greater than about 1/mm$^2$, greater than about 1.5 A/mm$^2$). Wavelength shifts due to varying current may result in difficulties in precisely controlling a desired color output of mixed color outputs from LEDs emitting different emission spectra (e.g., different peak wavelengths). For example, wavelength shift versus current may vary the resulting light color of mixed color primaries (e.g., from a red LED, green LED, and blue LED, which may be part of a combined light emitting component). Such variations may be especially problematic when LEDs are switched rapidly, for example, using pulse-width modulation or frequency-modulation control of LEDs, so that the LEDs spend a significant portion (e.g., greater than about 10%, greater than about 25%, greater than about 50%, greater than about 75%) of their on-state time experiencing rising and falling current. In such applications, fast rise/fall times may facilitate precise color control of mixed emitted light.

The inventors have appreciated that the above-mentioned difficulties may be, in part or in whole, alleviated by using the designs described herein.

Referring again to FIGS. 1A-1C, flexible cable 200 can be configured to transmit electrical power to the light-emitting diode. Flexible cable 200 can have first end 220 and second end 230. The first end 220 of the flexible cable 200 can be configured to allow for electrical connection to the light-emitting diode. The second end 230 can be configured to allow for electrical connection to a power converter module that can supply electrical power.

The LED connection cables described herein can provide a wiring solution having low wiring inductance, electromagnetic interference, and reduced ground bounce. In some embodiments, one or more switches (e.g., field-effect transistors), connected in parallel with one or more LEDs, can shunt electrical current from the LED(s), thereby allowing for the LED(s) drive current to be pulsed. The switch(es) can be located on the connection cable, and can be located on the end of the cable close to the LED(s).

Flexible cable 200 may comprises a first electrically conductive layer 202, a second electrically conductive layer 206 disposed over the first electrically conductive layer 202. The first and second electrically conductive layers (202 and 206) can substantially overlay each other and have substantially the same area, and an electrically insulating layer 204 may be disposed between the first and second electrically conductive layers (202 and 206). An electrically insulating material, for example electrically insulating layers 208 and 210, may protect and insulate the first and second electrically conductive layers (202 and 206). Electrically insulating layers 208 and 210 may be part of an electrically insulating cladding layer that surrounds layers 202, 204, and 206.

Electrically conductive layers may include metal layers (e.g., copper, silver, aluminum, and/or alloys thereof). Electrically insulating layers may include polymer layers (e.g., DuPont Kapton® polyimide films).

Figures 2A, 2B:
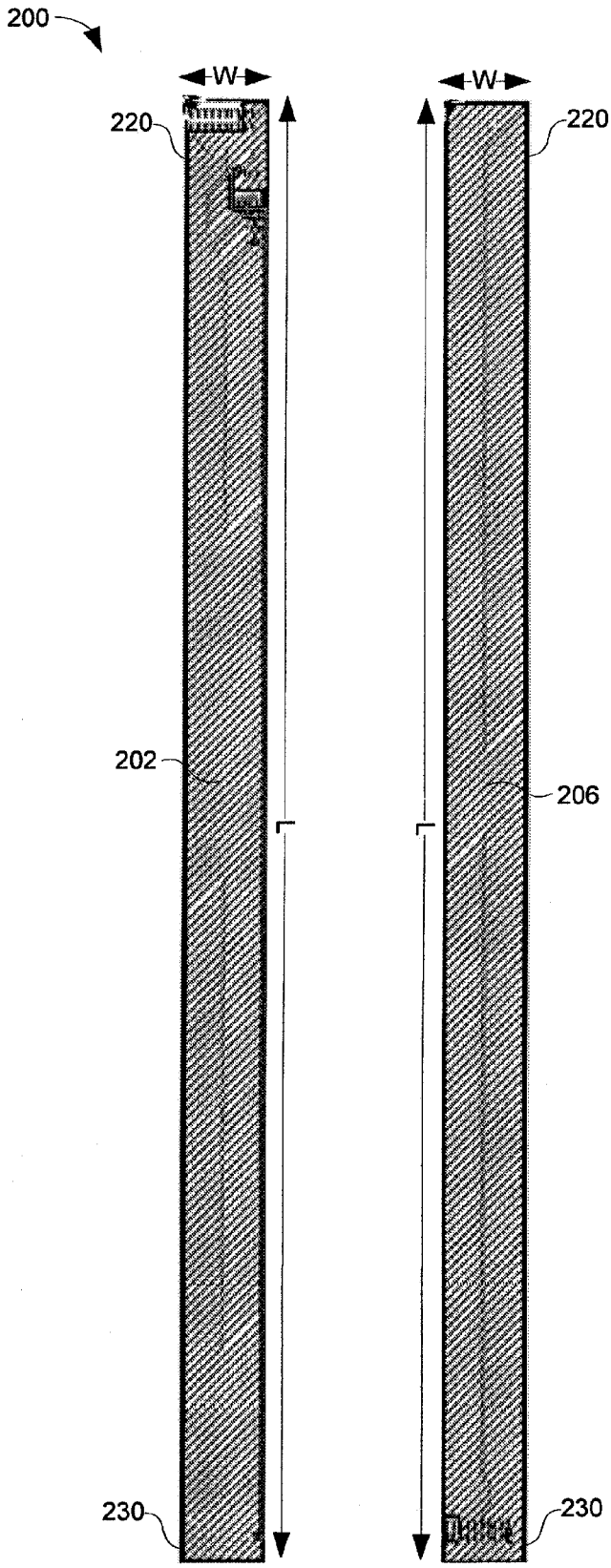
FIG. 2A is a top view of a first electrically conductive layer of a flexible cable, in accordance with one embodiment.
FIG. 2B is a top view of a second electrically conductive layer of the flexible cable of FIG. 2A, in accordance with one embodiment.

FIG. 2A illustrates a top view of the first electrically conductive layer 202 of a flexible cable 200. FIG. 2B illustrates a top view of the second electrically conductive layer 206 of the flexible cable 200. The second electrically conductive layer 206 can be disposed over the first electrically conductive layer 202. The first and second electrically conductive layers (202 and 206) can substantially overlay each other and have substantially the same area, and an electrically insulating layer 204 may be disposed between the first and second electrically conductive layers (202 and 206). The flexible cable 200 can be configured to provide electromagnetic interference protection. For instance the first and second electrically conductive layers (202 and 206) can serve a anode and cathode (or vice versa, cathode and anode) layers that electrically connect to the corresponding terminals of the LED. Such a configuration can provide for electromagnetic interference protection. Such a configuration can provide for a low electrical inductance.

A first end 220 of the flexible cable 200 may be connected to an LED module. The second end 230 of the flexible cable 200 can be connected to a power converter module that can supply electrical power to the LED via the flexible cable 200. In some embodiments, the length (L) of the flexible cable 200 is greater than about 10 cm (e.g., greater than about 20 cm, greater than about 30 cm) and/or less than about 50 cm (e.g., less than about 40 cm, less than about 30 cm).

Figure 3A:
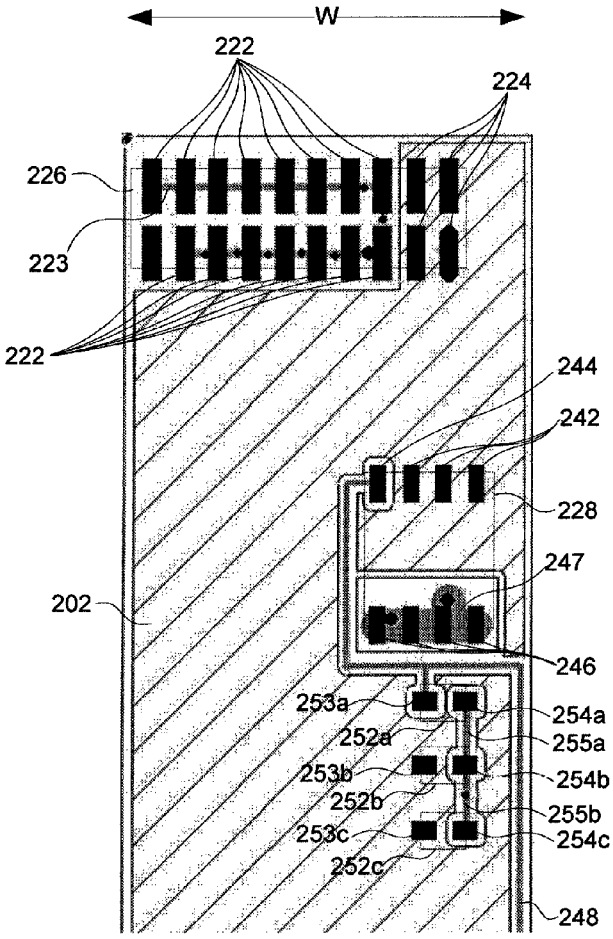
FIG. 3A is a top view of the first electrically conductive layer of the flexible cable of FIGS. 2A-B at the cable end configured to connect to the LED, in accordance with one embodiment.
Figure 3B:
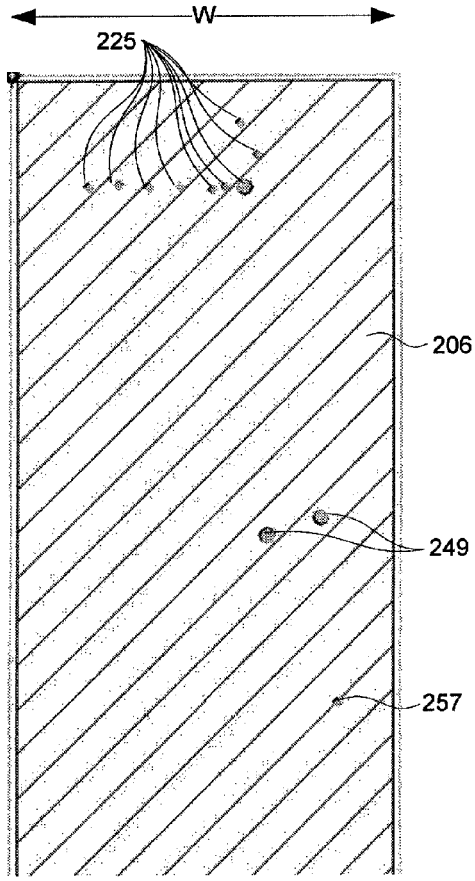
FIG. 3B is a top view of the second electrically conductive layer of the flexible cable of FIGS. 2A-B at the cable end configured to connect to the LED, in accordance with one embodiment.

FIG. 3A illustrates a top view of the first electrically conductive layer 202 of the flexible cable 200 of FIGS. 2A-B at the cable end configured to connect to the LED. FIG. 3B illustrates a top view of the second electrically conductive layer 206 of the flexible cable 200 of FIGS. 2A-B at the cable end configured to connect to the LED. The first electrically conductive layer 202 and/or the second electrically conductive layer 206 can each comprise a metal layer, such as a copper or copper alloy layer. The thickness of the electrically conductive layers 202 and/or 206 can be greater than about 0.05 mm and/or less than about 0.1 mm. In some embodiments, the electrically conductive layers 202 and/or 206 can be about 0.07 mm. In some embodiments, the width (W) of the electrically conductive layers 202 and/or 206 can be greater than about 0.5 cm (e.g., greater than about 1 cm, greater than about 1.5 cm, greater than about 2 cm) and/or less than about 5 cm (e.g., less than about 4 cm, less than about 3 cm, less than about 2 cm).

Flexible cable 200 can comprise electrically conductive contact pads 222, 224, and 222 (e.g., metal, such as a solder layer, such as a HAL finish on copper layer) that can allow for electrical connection to corresponding electrically conductive pads on an LED module. In some embodiments, an electrical connector (e.g., a male or female electrical pin connector), as illustrated by outline 226, can be attached (e.g., by reflowing the solder pads) to the contact pads 222, 224, and 222. The electrical connector can be configured to mate with a corresponding connector attached to a package substrate of the LED module.

Electrically conductive pads 224 can be disposed in electrical contact (e.g., directly on) the first electrically conductive layer 202. Electrically conductive line 223 (e.g., a metal line, such as a copper or copper alloy line) can provide for electrical connection between contact pads 222. Electrically conductive vias 225 (e.g., metal filled vias) can provide for electrical connection between the contact pads 222 and the second electrically conductive layer 206. Thus, contact pads 224 and 222 can provide for electrical connection between an LED module (not shown) and the first and second electrically conductive layers 202 and 206 of the flexible cable 200, respectively.

In some embodiments, a switch can be arranged in parallel with the light-emitting diode, wherein the switch is configured to provide a shunt path when in a first state and an open circuit when in a second state. In some embodiments, the switch can comprise a field-effect transistor (FET). In some embodiments, the flexible cable 200 can comprise the switch. In FIG. 3A, outline 228 illustrates a location on flexible cable 200 where electrical terminals of a switch (e.g., FET) can be attached to electrically conductive pads 242, 244, and 246. Electrically conductive pads 242 can be in electrical contact with the first electrically conductive layer 202. Electrically conductive pads 246 can be electrically connected with an electrically conductive line 247 and electrically conductive vias 249 (e.g., metal vias) can provide for electrical connection between the electrically conductive line 247 and the second electrically conductive layer 206. Electrically conductive pads 242 and 246 can provide for electrical connection to the source and drain terminals of the switch, respectively. Alternatively, electrically conductive pads 242 and 246 can provide for electrical connection to the drain and source terminals of the switch, respectively.

Electrically conductive pad 244 can serve as a pad for a control terminal (e.g., gate terminal) of the switch (e.g., FET). An electrically conductive line 248 can be electrically connected to the electrically conductive pad 244 and can serve as a third electrically conductive layer configured to transmit a control signal to the control terminal of the switch. The control signal can place the switch in an open or closed state, and therefore serve to provide for an open (open circuit) or closed (short circuit) configuration, whereby electrical current (e.g., provided from a power converter) can be sent to the LED when the switch is in an open state (open circuit state) and diverted through the switch (e.g., and not substantially through the LED) when the switch is in a closed state (short circuit state).

In some embodiments, the switch may be electrically connected to passive circuit elements (e.g., resistors, capacitors, and/or inductors). The passive circuit elements can serve as a snubbing circuit, which can reduce or eliminate any high frequency signal spikes associated with the switching of the switch. In some embodiments, the passive circuit elements that comprise the snubbing circuit can include one or more resistors and one or more capacitors. Examples of such passive circuit elements may be located at one or more outlined locations 252*a*, 252*b*, and/or 252*c*. Electrically conductive pads 253*a* and 254*a* can serve as attachment pads for terminals of a first passive circuit element (indicated by outline 252*a*), such a first resistor. Electrically conductive pads 253*b* and 254*b* can serve as attachment pads for terminals of a second passive circuit element (indicated by outline 252*b*), such as a second resistor. Electrically conductive pads 253*c* and 254*c* can serve as attachment pads for terminals of a third passive circuit element (indicated by outline 252*c*), such as a capacitor.

Electrically conductive line 255*a* can provide electrical connection between electrically conductive pad 254*a* and 254*b*. Electrically conductive line 255*b* can provide electrical connection between electrically conductive pad 254*b* and 254*c*. An electrically conductive via 257 (e.g., metal via) can electrically connect electrically conductive line 255*b* to the second electrically conductive layer 206.

Figure 4A:
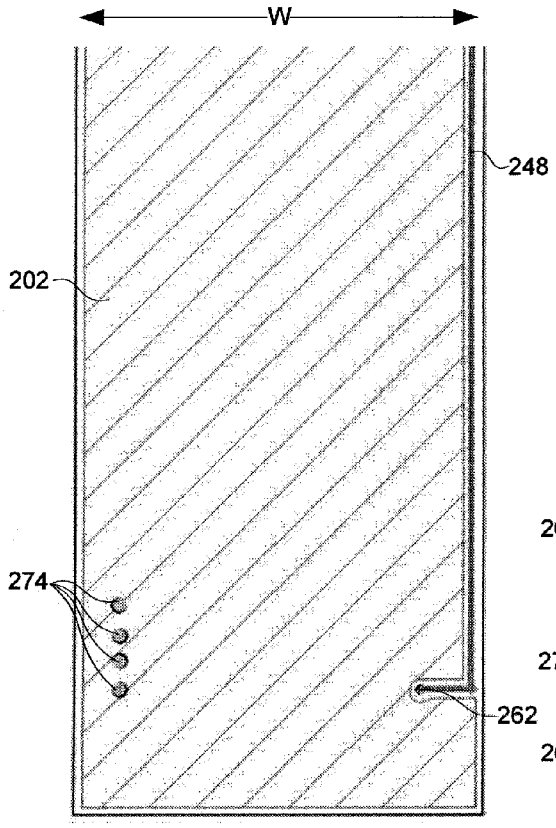
FIG. 4A is a top view of the first electrically conductive layer of the flexible cable of FIGS. 2A-B at the power input end that can be configured to connect to a power converter module, in accordance with one embodiment.
Figure 4B:
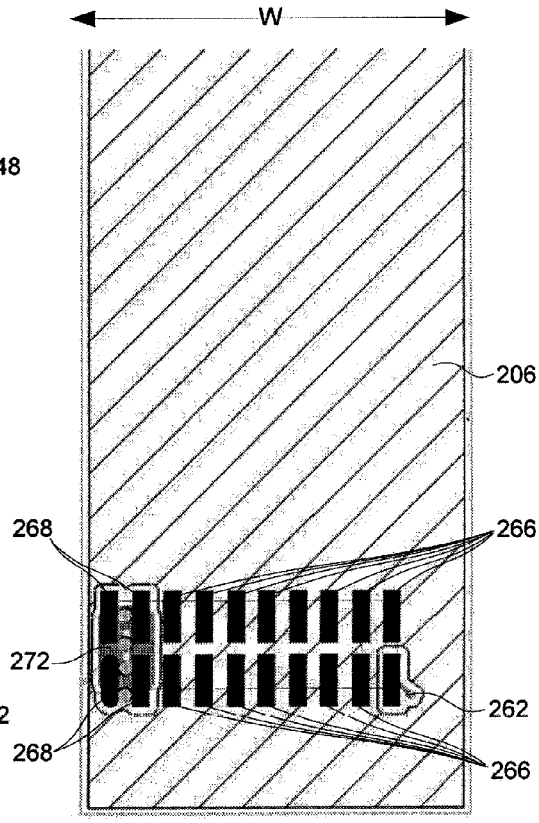
FIG. 4B is a top view of the second electrically conductive layer of the flexible cable of FIGS. 2A-B at the power input end that can be configured to connect to the power converter module, in accordance with one embodiment.

FIG. 4A illustrates a top view of the first electrically conductive layer 202 of the flexible cable 200 of FIGS. 2A-B at the power input end that can be configured to connect to the power converter module. FIG. 4B illustrates a top view of the second electrically conductive layer 206 of the flexible cable 200 of FIGS. 2A-B at the power input end that can be configured to connect to the power converter module.

Electrically conductive pads 264, 268, and 264 can provide for electrical connection to a power converter module (not shown). In some embodiments, a connector (e.g., male or female connector) may be attached to the conductive pads 264, 268, and 264, which can provide for the electrical connection to a corresponding connector of the power converter module.

Electrical pad 264 can be electrically connected to an electrically conductive via 262 that can provide for electrical connection to the electrically conductive line 248, which can serve as the control signal line for the switch that may be in parallel electrical connection with the LED, as discussed previously. Electrical pads 266 can be in electrical contact (e.g., disposed directly in contact) with the second electrically conductive layer 206. Electrical pads 268 can be in electrical contact with an electrically conductive line 272 having electrically conductive vias 274 passing through line 272. Electrically conductive vias 274 can be in electrical connection with the first electrically conductive layer 202.

In the configuration illustrated in FIGS. 4A-B, the switch control signal can be provided via an external electrical connection. The source of the switch control signal may be the power converter module and/or any other suitable module. The control signal can be used to control (e.g., turn on and turn off) the LED by shunting current to or from the LED path via the switch parallel shunt path.

Although the cables illustrated so far include only one connection channel (e.g., for one LED or multiple LEDs operating in unison, in series and/or parallel connection), in some embodiments, a flexible cable can have a plurality of channels (e.g., two, three, four, five, etc.) which can be used to individually provide power to a plurality of LEDs.

Figure 5A:
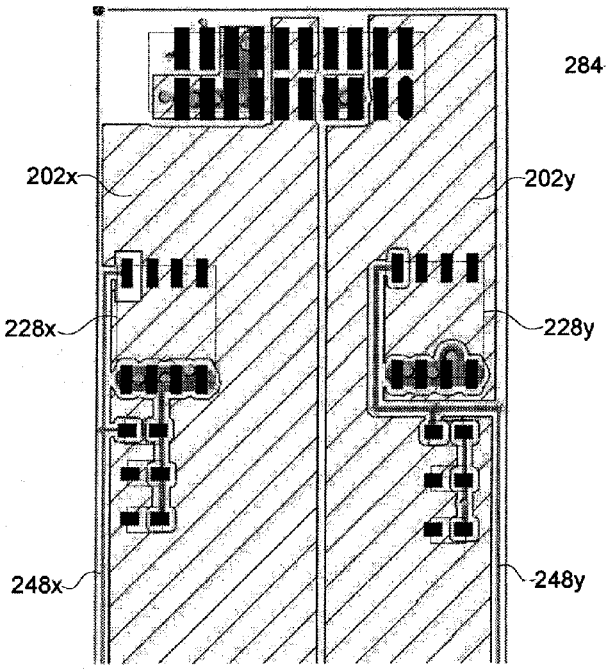
FIG. 5A is a top view of the first electrically conductive layer of a flexible cable at the cable end configured to connect to a plurality of LEDs, in accordance with one embodiment.
Figure 5B:
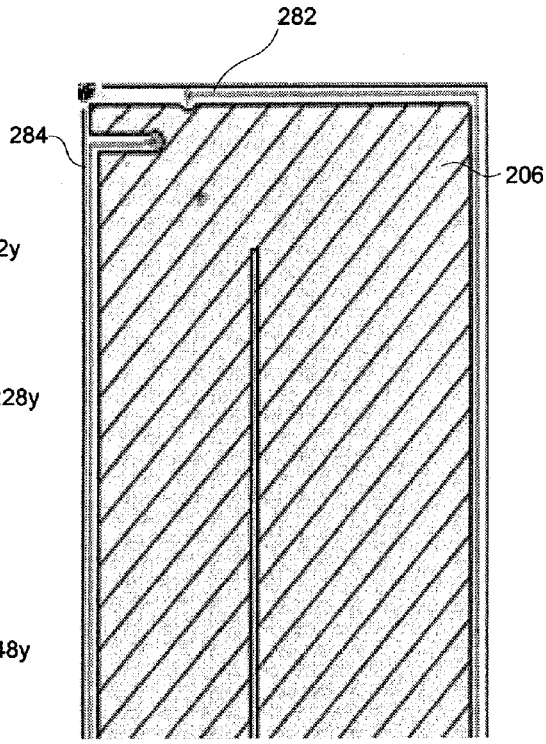
FIG. 5B is a top view of the second electrically conductive layer of the flexible cable of FIG. 5A, in accordance with one embodiment.

FIG. 5A illustrates a top view of the first electrically conductive layer 202 of a flexible cable at the cable end configured to connect to a plurality of LEDs (e.g., two individually addressable LEDs). FIG. 5B illustrates a top view of the second electrically conductive layer 206 of the flexible cable at the cable end configured to connect to a plurality of LEDs. The flexible cable illustrated in FIG. 5A-B can provide two channels for transmitting electrical power to two individually addressable LEDs. Separate switches (e.g., FETs) can be connected in parallel with the LEDs and can provide for switching (e.g., turning the LEDs on and off) of the LEDs. The flexible cable can include the switches, as illustrated in FIGS. 5A-B by outlines 228*x* and 228*y*. Separate control signal lines (248*x* and 248*y*) can transmit separate control signals to the control terminals (e.g., gate terminals) of the switches.

In some embodiments, the first electrically conductive layer comprises a first electrically conductive portion 202*x* and a second electrically portion 202*y* that are electrically insulated from each other. The first electrically conductive portion 202*x* can be configured to at least in part provide electrical power a first light-emitting diode and the second electrically conductive portion 202*y* can be configured to at least in part provide electrical power to the second light-emitting diode.

The first electrically conductive portion 202*x* can be electrically connected to a cathode of the first light-emitting diode. The second electrically portion 202*y* can be electrically connected to a cathode of the second light-emitting diode. In some embodiments, the second electrically conductive layer 206 can be electrically connected to an anode of the first light-emitting diode and an anode of the second light-emitting diode. In one embodiment, the second electrically conductive layer 206 can be configured to be electrically grounded.

In some embodiments, the flexible cable can also include electrically conductive lines (e.g., metal trace lines) that are configured to allow for connection to other electrical components that are part of the LED module. For example, electrically conductive lines 282 and 284 can be configured to electrically connect to monitoring component that is part of the LED module, for example a temperature monitoring component such as a thyristor or a light detector such as a photodiode.

Figure 6A:
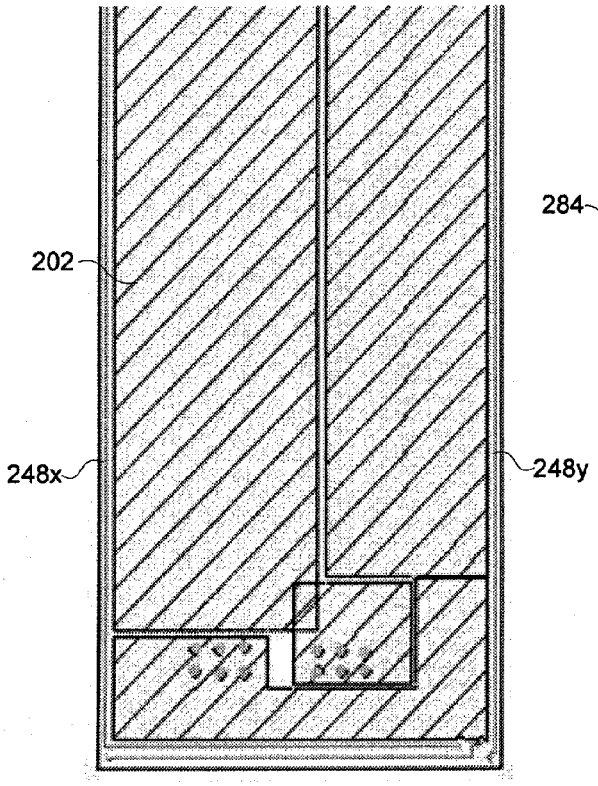
FIG. 6A is a top view of the first electrically conductive layer of a flexible cable of FIGS. 5A-B at a power input end that can be configured to connect to the power converter module, in accordance with one embodiment.
Figure 6B:
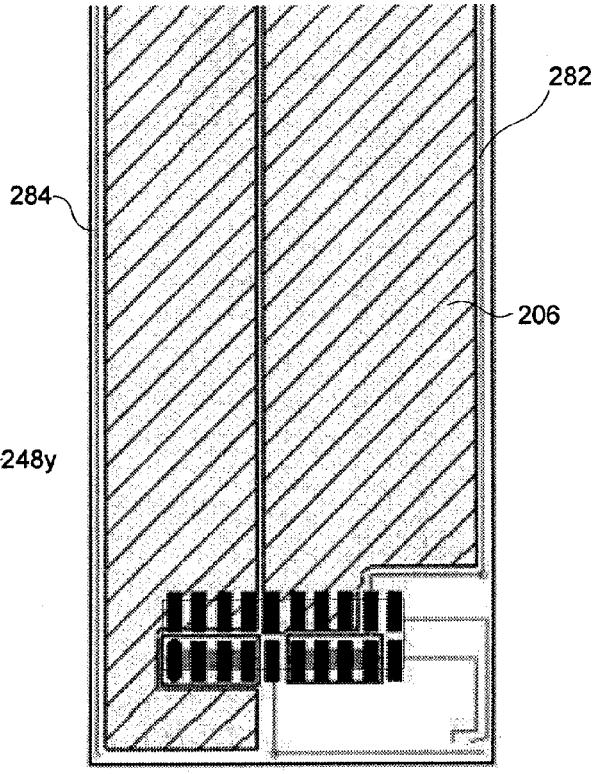
FIG. 6B is a top view of the second electrically conductive layer of the flexible cable of FIGS. 5A-B at a power input end that can be configured to connect to the power converter module, in accordance with one embodiment.

FIG. 6A illustrates a top view of the first electrically conductive layer 202 of a flexible cable of FIGS. 5A-B at a power input end that can be configured to connect to the power converter module. FIG. 6B illustrates a top view of the second electrically conductive layer 206 of the flexible cable of FIGS. 5A-B at a power input end that can be configured to connect to the power converter module.

In the embodiments presented herein, the light output of an LED can be varied based on the electrical current provided to the LED. A regulated current may be provided to facilitate the control of the light output of the LED, and power converter (also referred to as a driver circuit herein) may be used to provide current to the LED. The driver circuit may include a current source, which may in turn comprise a current regulator that can output a desired current. The driver circuit may include one or more switches that can be switched so as to turn on and off the LED light emission by controlling the current supplied to the LED. The switches may include transistors, such as field-effect transistors or bipolar transistors. In some embodiments, the switch(es) may be located on the flexible cable that is connected to the LED module. In some embodiments, the switch(es) may be located in close proximity to the LED(s).

Figure 7:
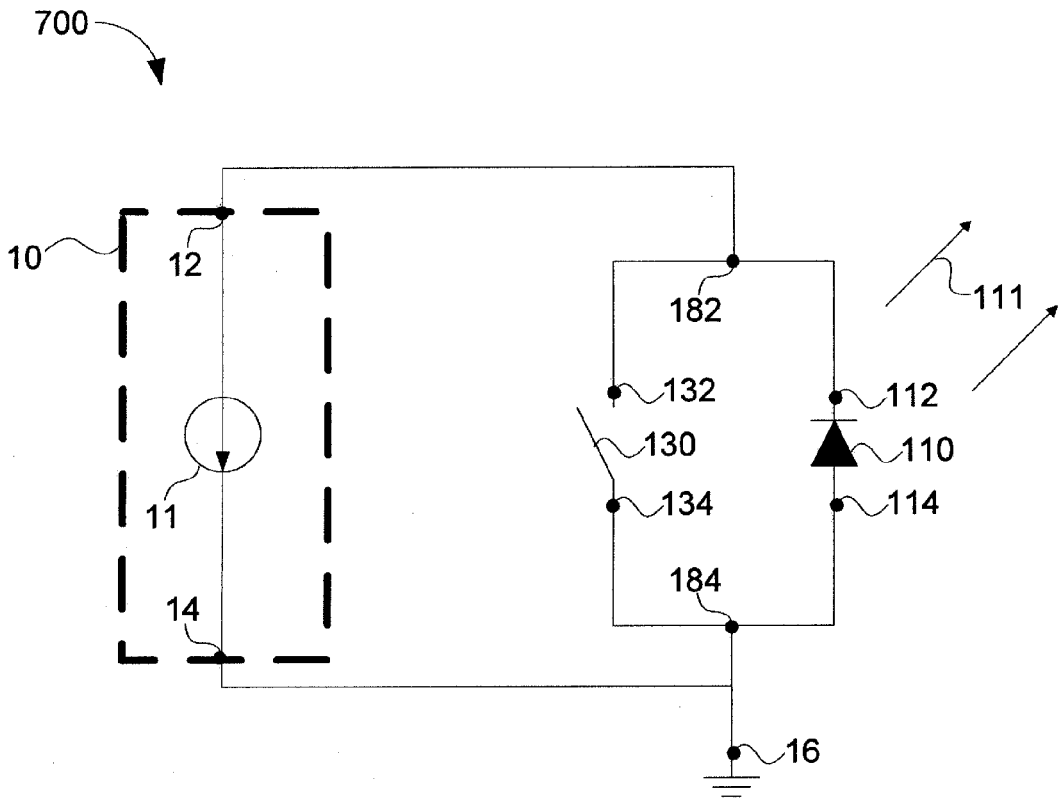
FIG. 7 is a schematic of circuit including a switching element electrically connected in parallel with an LED, in accordance with one embodiment.

FIG. 7 illustrates a schematic of circuit 700 where a switching element is electrically connected in parallel with an LED, in accordance with one embodiment. Circuit 700 may include an LED 110 that may be driven by a current so as to generate emitted light 111. LED 110 may have an anode terminal 114 and a cathode terminal 112. In some embodiments, as illustrated in the schematic of FIG. 7, the anode terminal 114 may be electrically connected to an electrical ground 16. However, it should be appreciated that some or all of techniques presented herein may be used for systems where the cathode of the LED is electrically connected to ground.

To control the current flowing through the LED, and hence the light emission, LED 110 may be electrically connected in parallel with switching element 130. Switching element 130 can be an electronic switch that can serve as an effective open circuit in a first state (e.g., open state) and an effective short circuit path in a second state (e.g., closed state). Switching element 130 may have a control terminal that allows for a signal (e.g., voltage or current) to be applied that sets whether switching element 130 is open or closed. Switching element 130 may have a first terminal 132 and a second terminal 134, and current can flow between these terminals when the switching element is closed. In this manner, current (e.g., at least some of the current, or substantially all of the current) may be diverted away from the LED 110 circuit path.

In some embodiments, switching element 130 is a transistor. Switching element 130 may include a field-effect transistor (FET) and/or a bipolar junction transistor (BJT). In some embodiments, the switching element may include a power field-effect transistor capable of handling high currents and may have a low drain to source on-resistance (e.g., less than about 5 mOhms). In some embodiments, the switching element may include an insulated gate bipolar transistor (IGBT). In some embodiments, the switching element may include a vertical transistor (e.g., FET, IGBT) where a backside of a semiconductor die may serve as a drain (or source) (or collector/emitter in the case of a IGBT) and a top surface of the semiconductor die may serve as source (or drain) (or emitter/collector in the case of a IGBT). In some embodiments, the switching element may be a silicon transistor, including but not limited to a silicon metal-oxide-semiconductor FET (MOSFET).

To achieve a parallel electrical connection between switching element 130 and LED 110, switching element terminal 132 may be electrically connected to terminal 112 of the LED 110, and switching element terminal 134 may be electrically connect to terminal 114 of LED 110.

In some embodiments, LED 110 and switching element 130 may be integrated in a common package. For instance, a common package may include a substrate 180 that supports both the LED 110 and the switching element 130. LED 110 and switching element 130 may be electrically interconnected with conductive lines (e.g., metal lines) on the package substrate, with wire bonds, with flip-chip bonding, and/or through an electrically conducting base substrate. The substrate may include an electrically insulating layer disposed over an electrically conducting base substrate, and conductive lines may be disposed over (e.g., directly on) the electrically insulating layer. Metal-filled vias extending through the electrically insulating layer may be used to provide for electrical connection to the electrically conducting base substrate.

In some embodiments, switching element 130 may be part of a cable that provided for electrical connection to the LED 110. In some embodiments, switching element 130 may be part of the electrical power converter (e.g., current regulator). In some embodiments, switching element 130 may be a separate from the electrical power converter and the LED module.

Circuit 100 can include a current source (or at least a portion of a current source) 11 that can be electrically connected (e.g., through electrically conductive wires) to the common substrate so as to provide current to the LED. In the illustration of FIG. 7, at least a portion of the current source 11 may be part of an assembly 10 (e.g., a circuit board) separate from substrate 180. Assembly 10 may include a substrate (e.g., separate from substrate 180) that can support circuit elements that form at least a portion of the current source 11. In some embodiments, the current source 11 may include a current regulator having an external voltage supply input.

As illustrated for circuit 700, current source 11 may have a first terminal 12 and a second terminal 14. Current generated by current source 11 can flow from terminal 12 to terminal 14. First terminal 12 of the current source 11 may be electrically connected (e.g., via electrical wiring) to a terminal 182. Terminal 182 may be electrically connected to terminal 132 of the switching element 130 and terminal 112 of the LED 110. Second terminal 14 of the current source 11 may be electrically connected (e.g., via electrical wiring) to a terminal 184. Terminal 184 may be electrically connected to terminal 134 of the switching element 130 and terminal 114 of the LED 110. Such an electrical connection arrangement may be used for a configuration where the anode of the LED 110 is electrically grounded.

In other embodiments, other arrangements allow for a configuration where the cathode of the LED 110 is grounded. For example, the current source 11 terminal connections may be reversed and the LED 110 terminal connections may also be reversed so that the cathode terminal of the LED is grounded.

Figure 8:
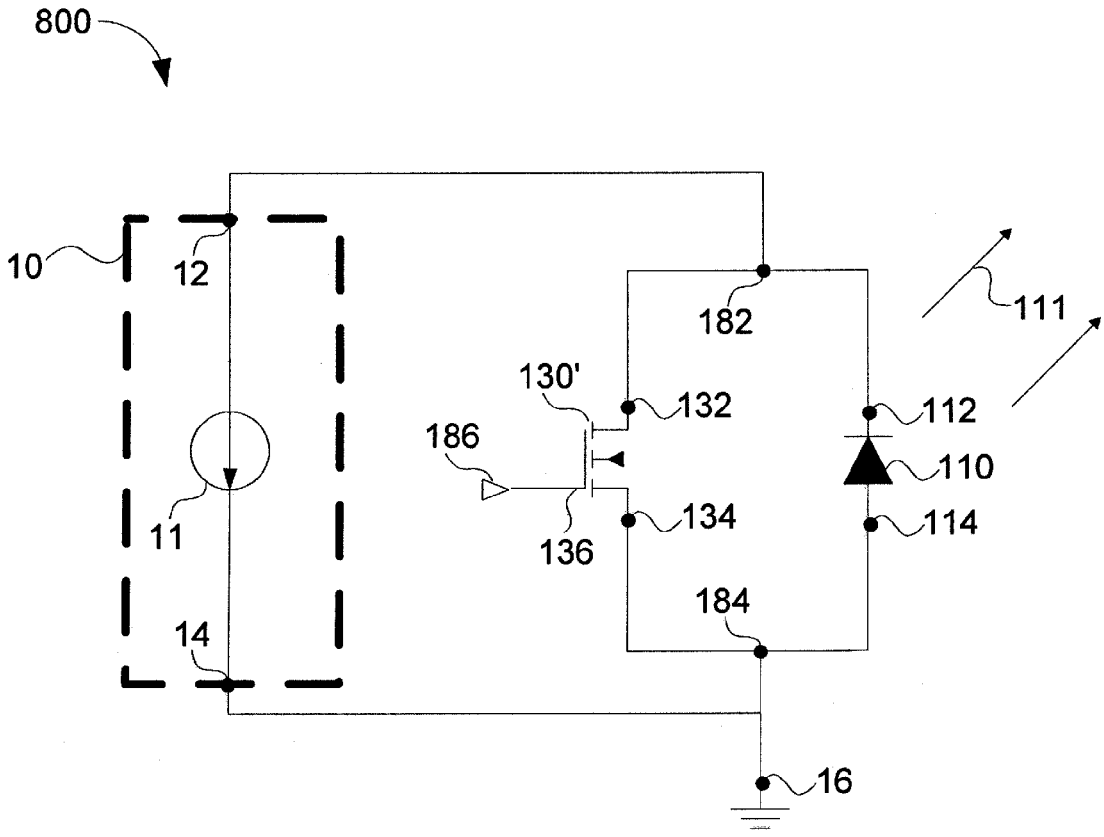
FIG. 8 is a schematic of circuit including a switching element electrically connected in parallel with an LED, in accordance with one embodiment.

FIG. 8 illustrates a schematic of circuit 800 where a FET switching element is electrically connected in parallel with an LED, in accordance with one embodiment. In the context of a FET switching element, the terminals 132 and 134 are referred to as the source and drain terminals. A gate terminal 136 of FET 130' may be electrically connected to an input control terminal 186. FET switching element 130' may be a power FET, such as a vertical diffused MOSFET (DMOS). The FET switching element 130' may be an n-type or p-type FET, and may be an enhancement mode or depletion mode device. In some embodiments, the switching element may include two or more FETs, for example, the switching element may include an n-type and a p-type FET configured to form an analog switch.

In embodiments where FET switching element 130' is an enhancement mode device, the FET is in an off state (e.g., acts as an open circuit) when no voltage is applied to a gate terminal 136 of the FET, and no current can flow between terminals 132 and 134 of the FET. In such a state, current flows though the LED 110. When a voltage greater than a threshold voltage is applied to the gate terminal 136, the enhancement mode FET can be switched to an open state (e.g., acts as a short circuit) and current can flow between terminals 132 and 134 of the FET. In such a state, current does not flow through the LED 110.

In embodiments where the FET switching element 130' is a depletion mode device, the FET is in an on state (e.g., acts as a closed circuit) when no voltage is applied to a gate terminal 136 of the FET, and current can flow between terminals 132 and 134 of the FET. In such a state, current does not flow through the LED 110. When a voltage greater than a threshold voltage is applied to the gate terminal 136, a depletion mode FET can be switched to a closed state (e.g., acts as an open circuit) and no current can flow between terminals 132 and 134 of the FET. In such a state, current flows through LED 110.

Since the FET switching element can act as an effective short circuit when in a closed state, the parallel electrical connection of the FET switching with LED 110 allows for the diverting of current (e.g., at least some current or substantially all the current provided by the current source 11) away from the LED 110 circuit path when FET 130' is in a closed state. When FET 130' is in an open state, the FET 130' circuit path is an open circuit, and current provided by the current source 11 passes through LED 110 and the LED 110 emits light 111.

In some embodiments, a switching element having fast switching times (e.g., small rise and fall times) is connected in parallel with an LED. In some embodiments, the switching element may have fast switching times (e.g., rise and/or fall times) of less than about 100 ns (e.g., less than about 75 ns, less than about 50 ns, less than about 25 ns, less than about 10 ns). The rise/fall times of current switching in the LED may be ultimately limited by the switching time (e.g., rise and/or fall time) of the switching element. By reducing the interconnection inductance and/or capacitance (e.g., by reducing the interconnection distance) between the LED and the switching element, the switching time (e.g., rise and/or fall time) for current in the LED may approach the switching time (e.g., rise and/or fall time) of the switching element. In some embodiments, the switching time (e.g., rise and/or fall time) for current in the LED is equal to or less than about 10 times (e.g., less than about 5 times, less than about 3 times, less than about 2 times, about 1 time) the switching time (e.g., rise and/or fall time) of the switching element.

Although the rise and/or fall times of the switching element may be fast, the switching time for the LED may be larger since the wiring inductance between the switching element and the LED may limit current changes in the circuit. As such, a decrease in the wiring inductance between the switching element and the LED may provide for faster switching (e.g., small rise and fall times) of the current flowing through the LED and hence of the light output of the LED. For example, the flexible cable designs presented herein can have low inductance due to the overlaid cathode and anode electrically conductive layers, referred to as the first and second electrically conductive layers.

In the illustrated circuits of FIGS. 7 and 8, the interconnection inductance between the LED 110 and the switching element correspond to the inductance of the electrical interconnections (e.g., electrically conductive path, such as wires, metal traces, metal substrates) between terminal 132 of switching element 130 and terminal 112 of LED 110, and similarly between terminal 134 of the switching element 130 and terminal 114 of the LED 110. A minimization of the interconnection inductance can reduce the rise and fall times associated with switching the LED light output. In some embodiments, the interconnection inductance between the LED and the switching element is less than about 100 nanoHenries (e.g., less than about 50 nanoHenries, less than about 25 nanoHenries, less than about 10 nanoHenries, less than about 5 nanoHenries, less than about 1 nanoHenries).

In some embodiments, a reduced interconnection inductance between an LED and a switching element may be achieved at least in part by locating the switching element in close proximity to the LED, such as locating the switching element on the LED connection end of the flexible cable. In some embodiments, the LED and the switching element can integrate in a common package. The LED and the switching element may be integrated on a common substrate, including but not limited to a common die (e.g., monolithic integration), a common sub-mount, a common sub-package, and/or a common metal-core board.

LED 110 may be integrated on a package substrate 180. Substrate 180 may include electrically conducting regions and/or electrically insulating regions. Substrate 180 can include an electrically conductive base substrate. The electrically conductive base substrate may be formed of one or more electrically conductive materials, such as one or more metals (e.g., copper, gold, aluminum, alloys thereof). Substrate 180 may include an electrically insulating layer, such as a dielectric layer (e.g., a ceramic layer, a polymer layer). The electrically insulating layer may be disposed over (e.g., directly on) the electrically conductive base substrate. Electrically conductive trace lines (e.g., metal lines, such as copper lines) may be disposed over (e.g., directly on) the electrically insulating layer so as to be electrically isolated from the base substrate. In some embodiments, substrate 180 can be thermally conductive, and therefore can facilitate the conduction of heat way from LED 110.

In some embodiments, part or all of substrate 180 may be electrically grounded. A grounded base substrate can provide an electrical ground plane for one or more devices supported by substrate at 180. One or more terminals of LED 110 may be grounded to the electrical ground plane provided by base substrate, for example, by electrical connection through via (s) (e.g., metal filled vias) that can provide for electrical connection between base substrate and components supported by substrate 180.

LED 110 may include first and second electrical terminals 112 and 114 (e.g., cathode and anodes terminals). As previously mentioned, in some embodiments, a backside of LED 110 may serve as an electrical terminal (e.g., cathode or anode terminal). LED 110 may emit light 111 through an emission surface area (e.g., parallel to the substrate 180). In some embodiments, LED 110 includes a large area LED die or multiple LED dies (e.g., multiple large area dies) arranged substantially proximate each other. Multiple LED dies can be electrically connected in series or parallel, and may emit the same peak wavelengths of light or some or all of the LED dies may emit different peak wavelengths of light. LED 110 may have an emission surface area greater than about 1 $mm^2$(e.g., greater than about 2 $mm^2$, greater than about 3 $mm^2$, greater than about 5 $mm^2$, greater than about 10 $mm^2$, greater than about 20 $mm^2$).

In some embodiments, at least about 45% (e.g., at least about 50%, at least about 55%, at least about 60%, at least about 70%, at least about 80%, at least about 90%, at least about 95%) of the total amount of light generated by a light-generating region (e.g., active region of the LED) that emerges from LED emerges via an emission surface area of the LED. In some embodiments, the emission area of LED 110 can be relatively large, while still exhibiting efficient light extraction from LED 110. For example, one or more edges of LED 110 can be at least about 1 mm long (e.g., at least about 1.5 mm long, at least about 2 mm long, at least about 2.5 mm long, at least about 3 mm long, at least about 5 mm long), and at least about 45% (e.g., at least about 50%, at least about 55%, at least about 60%, at least about 70%, at least about 80%, at least about 90%, at least about 95%) of the total amount of light generated by a light generating region (e.g., active region of the LED) that emerges from LED 110 emerges via emission surface area. This can allow for an LED to have a relatively large emission surface area (e.g., at least about 1 mm by at least about 1 mm) while exhibiting good power conversion efficiency. In some embodiments, the extraction efficiency of an LED 110 is substantially independent of the length of the edge of the LED. As referred to herein, the extraction efficiency of an LED is the ratio of the light emitted by the LED to the amount of light generated by the device (which can be measured in terms of energy or photons). This can allow for an LED to have a relatively large emission surface area (e.g., at least about 1 mm by at least about 1 mm) while exhibiting good power conversion efficiency.

A large emission surface area of LED 110 allows for high light output from LED 110. To achieve a high light output from a large area LED, a high electrical current (e.g., greater than 1 Amps, greater than 2 Amps, greater than 5 Amps, greater than 10 Amps, greater than 20 Amps) can be provided to the LED 110 via the cathode and/or anode terminals of the LED 110. In some instances, it may be desirable to have short rise/fall time (e.g., less than 1 μs, less than 500 ns, less than 300 ns, less than 200 ns, less than 100 ns, less than 50 ns) operation of the LED. In some embodiments, to enable such fast rise/fall times in conjunction with large electrical currents provided to the LED, a switching element that can control current flowing through the LED can be integrated as part of an electrical cable that is configured to provide electrical power to the LED. In some embodiments, the switching element can be in close proximity to the LED, as described previously.

Figure 9:
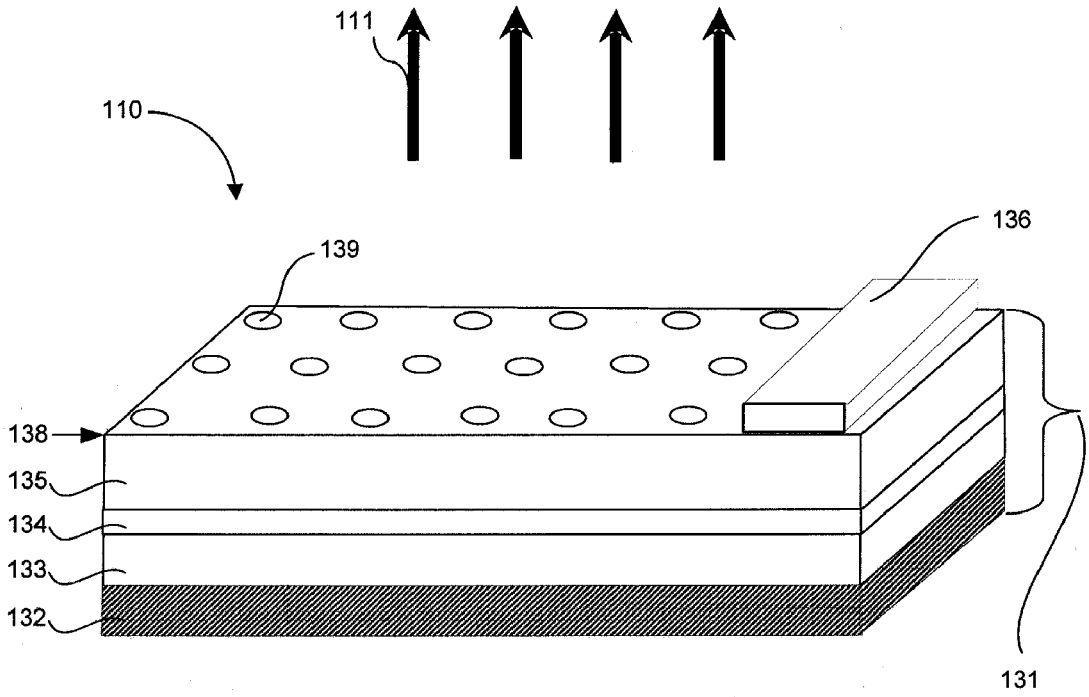
FIG. 9 is a schematic of a light emitting die.

FIG. 9 illustrates a light emitting diode (LED) that may be part of a light emitting module (e.g., LED module), in accordance with one embodiment. It should also be understood that various embodiments presented herein can also be applied to other light emitting devices, such as laser diodes, and LEDs having different structures (such as organic LEDs, also referred to as OLEDs).

LED 110 shown in FIG. 9 comprises a multi-layer stack 131 that may be disposed on a support structure (e.g., a sub-mount). The multi-layer stack 131 can include an active region 134 which is formed between n-doped layer(s) 135 and p-doped layer(s) 133. The stack can also include an electrically conductive layer 132 which may serve as a p-side contact, which can also serve as an optically reflective layer. An n-side contact pad 136 is disposed on layer 135. It should be appreciated that the LED is not limited to the configuration shown in FIG. 9, for example, the n-doped and p-doped sides may be interchanged so as to form a LED having a p-doped region in contact with the contact pad 136 and an n-doped region in contact with layer 132. As described further below, electrical potential may be applied to the contact pads which can result in light generation within active region 134 and emission of at least some of the light generated through an emission surface 138. As described further below, openings 139 may be defined in a light-emitting interface (e.g., emission surface 138) to form a pattern that can influence light emission characteristics, such as light extraction and/or light collimation. It should be understood that other modifications can be made to the representative LED structure presented, and that embodiments are not limited in this respect.

The active region of an LED can include one or more quantum wells surrounded by barrier layers. The quantum well structure may be defined by a semiconductor material layer (e.g., in a single quantum well), or more than one semiconductor material layers (e.g., in multiple quantum wells), with a smaller electronic band gap as compared to the barrier layers. Suitable semiconductor material layers for the quantum well structures can include InGaN, AlGaN, GaN and combinations of these layers (e.g., alternating InGaN/GaN layers, where a GaN layer serves as a barrier layer). In general, LEDs can include an active region comprising one or more semiconductors materials, including III-V semiconductors (e.g., GaAs, AlGaAs, AlGaP, GaP, GaAsP, InGaAs, InAs, InP, GaN, InGaN, InGaAlP, AlGaN, as well as combinations and alloys thereof), II-VI semiconductors (e.g., ZnSe, CdSe, ZnCdSe, ZnTe, ZnTeSe, ZnS, ZnSSe, as well as combinations and alloys thereof), and/or other semiconductors. Other light-emitting materials are possible such as quantum dots or organic light-emission layers.

The n-doped layer(s) 135 can include a silicon-doped GaN layer (e.g., having a thickness of about 4000 nm thick) and/or the p-doped layer(s) 133 can include a magnesium-doped GaN layer (e.g., having a thickness of about 40 nm thick). The electrically conductive layer 132 may be a silver layer (e.g., having a thickness of about 100 nm), which may also serve as a reflective layer (e.g., that reflects upwards any downward propagating light generated by the active region 134). Furthermore, although not shown, other layers may also be included in the LED; for example, an AlGaN layer may be disposed between the active region 134 and the p-doped layer (s) 133. It should be understood that compositions other than those described herein may also be suitable for the layers of the LED.

As a result of openings 139, the LED can have a dielectric function that varies spatially according to a pattern. The dielectric function that varies spatially according to a pattern can influence the extraction efficiency and/or collimation of light emitted by the LED. In some embodiments, a layer of the LED may have a dielectric function that varies spatially according to a pattern. In the illustrative LED 110, the pattern is formed of openings, but it should be appreciated that the variation of the dielectric function at an interface need not necessarily result from openings. Any suitable way of producing a variation in dielectric function according to a pattern may be used. For example, the pattern may be formed by varying the composition of layer 135 and/or emission surface 138. The pattern may be periodic (e.g., having a simple repeat cell, or having a complex repeat super-cell), or non-periodic. As referred to herein, a complex periodic pattern is a pattern that has more than one feature in each unit cell that repeats in a periodic fashion. Examples of complex periodic patterns include honeycomb patterns, honeycomb base patterns, (2×2) base patterns, ring patterns, and Archimedean patterns. In some embodiments, a complex periodic pattern can have certain holes with one diameter and other holes with a smaller diameter. As referred to herein, a non-periodic pattern is a pattern that has no translational symmetry over a unit cell that has a length that is at least 50 times the peak wavelength of light generated by one or more light-generating portions. Examples of non-periodic patterns include aperiodic patterns, quasi-crystalline patterns (e.g., quasi-crystal patterns having 8-fold symmetry), Robinson patterns, and Amman patterns. A non-periodic pattern can also include a detuned pattern (as described in U.S. Pat. No. 6,831,302 by Erchak, et al., which is incorporated herein by reference in its entirety). In some embodiments, a device may include a roughened surface. The surface roughness may have, for example, a root-mean-square (rms) roughness about equal to an average feature size which may be related to the wavelength of the emitted light.

In certain embodiments, an interface of a light-emitting device is patterned with openings which can form a photonic lattice. Suitable LEDs having a dielectric function that varies spatially (e.g., a photonic lattice) have been described in, for example, U.S. Pat. No. 6,831,302 B2, entitled "Light Emitting Devices with Improved Extraction Efficiency," filed on Nov. 26, 2003, which is herein incorporated by reference in its entirety. A high extraction efficiency for an LED implies a high power of the emitted light and hence high brightness which may be desirable in various optical systems.

It should also be understood that other patterns are also possible, including a pattern that conforms to a transformation of a precursor pattern according to a mathematical function, including, but not limited to an angular displacement transformation. The pattern may also include a portion of a transformed pattern, including, but not limited to, a pattern that conforms to an angular displacement transformation. The pattern can also include regions having patterns that are related to each other by a rotation. A variety of such patterns are described in U.S. patent application Ser. No. 11/370,220, entitled "Patterned Devices and Related Methods," filed on Mar. 7, 2006, which is herein incorporated by reference in its entirety.

Light may be generated by the LED as follows. The p-side contact layer can be held at a positive potential relative to the n-side contact pad, which causes electrical current to be injected into the LED. As the electrical current passes through the active region, electrons from n-doped layer(s) can combine in the active region with holes from p-doped layer(s), which can cause the active region to generate light. The active region can contain a multitude of point dipole radiation sources that generate light with a spectrum of wavelengths characteristic of the material from which the active region is formed. For InGaN/GaN quantum wells, the spectrum of wavelengths of light generated by the light-generating region can have a peak wavelength of about 445 nanometers (nm) and a full width at half maximum (FWHM) of about 30 nm, which is perceived by human eyes as blue light. The light emitted by the LED may be influenced by any patterned interface through which light passes, whereby the pattern can be arranged so as to influence light extraction and/or collimation.

In other embodiments, the active region can generate light having a peak wavelength corresponding to ultraviolet light (e.g., having a peak wavelength of about 370-390 nm), violet light (e.g., having a peak wavelength of about 390-430 nm), blue light (e.g., having a peak wavelength of about 430-480 nm), cyan light (e.g., having a peak wavelength of about 480-500 nm), green light (e.g., having a peak wavelength of about 500 to 550 nm), yellow-green (e.g., having a peak wavelength of about 550-575 nm), yellow light (e.g., having a peak wavelength of about 575-595 nm), amber light (e.g., having a peak wavelength of about 595-605 nm), orange light (e.g., having a peak wavelength of about 605-620 nm), red light (e.g., having a peak wavelength of about 620-700 nm), and/or infrared light (e.g., having a peak wavelength of about 700-1200 nm).

In certain embodiments, the LED may emit light having a high power. As previously described, the high power of emitted light may be a result of a pattern that influences the light extraction efficiency of the LED. For example, the light emitted by the LED may have a total power greater than 0.5 Watts (e.g., greater than 1 Watt, greater than 5 Watts, or greater than 10 Watts). In some embodiments, the light generated has a total power of less than 100 Watts, though this should not be construed as a limitation of all embodiments. The total power of the light emitted from an LED can be measured by using an integrating sphere equipped with spectrometer, for example a SLM12 from Sphere Optics Lab Systems. The desired power depends, in part, on the optical system that the LED is being utilized within. For example, a display system (e.g., a LCD system) may benefit from the incorporation of high brightness LEDs which can reduce the total number of LEDs that are used to illuminate the display system.

The light generated by the LED may also have a high total power flux. As used herein, the term "total power flux" refers to the total power divided by the emission area. In some embodiments, the total power flux is greater than 0.03 Watts/$mm^2$, greater than 0.05 Watts/$mm^2$, greater than 0.1 Watts/$mm^2$, or greater than 0.2 Watts/$mm^2$. However, it should be understood that the LEDs used in systems and methods presented herein are not limited to the above-described power and power flux values.

In some embodiments, the LED may be associated with a wavelength-converting region. The wavelength-converting region may be, for example, a phosphor region and/or a region including quantum dots. The wavelength-converting region can be disposed over (e.g., in contact with) the emission surface 138. The wavelength-converting region can absorb light emitted by the light-generating region of the LED and emit light having a different wavelength than that absorbed. In this manner, LEDs can emit light of wavelength(s) (and, thus, color) that may not be readily obtainable from LEDs that do not include wavelength-converting regions. Examples of LEDs with wavelength-converting regions are described in, for example, U.S. Pat. No. 7,196,354, entitled "Wavelength-converting Light Emitting Devices," filed on Sep. 29, 2005, which is herein incorporated by reference in its entirety.

As used herein, an LED may be an LED die, a partially packaged LED die, or a fully packaged LED die. It should be understood that an LED may include two or more LED dies associated with one another, for example a red-light emitting LED die, a green-light emitting LED die, a blue-light emitting LED die, a cyan-light emitting LED die, or a yellow-light emitting LED die. For example, the two or more associated LED dies may be mounted on a common package. The two or more LED dies may be associated such that their respective light emissions may be combined to produce a desired spectral emission. The two or more LED dies may also be electrically associated with one another (e.g., connected to a common ground).

As used herein, when a structure (e.g., layer, region) is referred to as being "on", "over" "overlying" or "supported by" another structure, it can be directly on the structure, or an intervening structure (e.g., layer, region) also may be present. A structure that is "directly on" or "in contact with" another structure means that no intervening structure is present.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A light emitting assembly comprising:

a light-emitting diode;

a power source;

a flexible cable connecting the power source and the light-emitting diode, the flexible cable comprising a first electrically conductive layer, a second electrically conductive layer disposed over the first electrically conductive layer, and an electrically insulating layer disposed between the first and second electrically conductive layers, wherein:

the first and second electrically conductive layers substantially overlay each other and have substantially the same area, the first end of the flexible cable is electrically connected to the light-emitting diode, and the flexible cable is configured to transmit electrical power to the light-emitting diode; and a switch on the flexible cable, wherein the switch is configured to provide current to the light-emitting diode from the power source when in a first state and to not provide current from the power source to the light-emitting diode when in a second state, wherein a distance between the light-emitting diode and the switch is less than 5 cm.

2. The assembly of claim 1, wherein the switch is arranged in parallel with the light-emitting diode.

3. The assembly of claim 1, wherein the switch comprises a field-effect transistor (FET).

4. The assembly of claim 1, further comprising a third electrically conductive layer configured to transmit a control signal to a control terminal of the switch.

5. The assembly of claim 1, wherein the switch is electrically connected to a cathode on the light-emitting diode.

6. The assembly of claim 1, wherein a distance between the light-emitting diode and the switch is less than 1 cm.

7. The assembly of claim 1, wherein the current provided to the light-emitting diode is greater than about 5 A.

8. A light emitting assembly, comprising:

a first light-emitting diode;

a second light-emitting diode;

a power source;

a flexible cable connecting the power source and the light emitting diodes, the flexible cable comprising a first electrically conductive layer; and a switch on the flexible cable, wherein:

the switch is configured to provide current to the light-emitting diode from the power source when in a first state and to not provide current from the power source to the light-emitting diode when in a second state;

a distance between the light-emitting diode and the switch is less than 5 cm;

the first electrically conductive layer comprises a first electrically conductive portion and a second electrically conductive portion that are electrically insulated from each other;

the first electrically conductive portion is configured to at least in part provide electrical power to the first light-emitting diode; and the second electrically conductive portion is configured to at least in part provide electrical power to the second light-emitting diode.

9. The assembly of claim 8, wherein the first electrically conductive portion is electrically connected to a cathode of the first light-emitting diode, the second electrically portion is electrically connected to a cathode of the second light-emitting diode, and wherein the second electrically conductive layer is electrically connected to an anode of the first light-emitting diode and an anode of the second light-emitting diode.

10. The assembly of claim 9, wherein the second electrically conductive layer is configured to be electrically grounded.

11. The assembly of claim 8, wherein a distance between the switch and the first light emitting diode and/or a distance between the switch and the second light emitting diode is less than 5 cm.

12. The assembly of claim 8, wherein a distance between the switch and the first light emitting diode and/or a distance between the switch and the second light emitting diode is less than 1 cm.

13. The assembly of claim 8, wherein the current provided to the first and/or second light emitting diode is greater than about 5 A.

14. The assembly of claim 8, wherein the switch comprises a field-effect transistor (FET).

* * * * *